US005551457A

United States Patent [19]

Williamson

[11] Patent Number: 5,551,457

[45] Date of Patent: Sep. 3, 1996

[54] HAIRSTYLING ROD

[76] Inventor: Diane L. Williamson, 3945 Angus La., Dayton, Ohio 45439

[21] Appl. No.: 339,936

[22] Filed: Nov. 15, 1994

[51] Int. Cl.[6] ..... A45D 2/08

[52] U.S. Cl. ..... 132/250; 132/248; 132/268; 132/253

[58] Field of Search ..... 132/246, 247, 132/248, 250, 251, 252, 254, 255, 256, 261, 268

[56] References Cited

U.S. PATENT DOCUMENTS

| | | | |
|---|---|---|---|
| 2,757,676 | 8/1956 | Hamilton . | |
| 2,964,046 | 12/1960 | Rubino | 132/251 |
| 3,080,873 | 3/1963 | Feist . | |
| 3,347,248 | 10/1967 | Weitzner | 132/252 |
| 3,848,610 | 11/1974 | Thomas | 132/250 |
| 4,056,109 | 11/1977 | Takai . | |
| 4,239,050 | 12/1980 | Leuzzi . | |
| 4,310,008 | 1/1982 | Lalli . | |
| 4,465,085 | 8/1984 | Schopieray | 132/248 |
| 4,732,169 | 3/1988 | Van Sickle | 132/248 |
| 4,809,719 | 3/1989 | Holman . | |
| 5,193,558 | 3/1993 | Squatrito . | |
| 5,316,021 | 5/1994 | Giordano | 132/248 |

*Primary Examiner*—Cary E. O'Connor
*Assistant Examiner*—Pedro Philogene
*Attorney, Agent, or Firm*—Killworth, Gottman, Hagan & Schaeff

[57] ABSTRACT

A rod device is provided for rolling a lock of hair during permanent wave hairstyling. The rod device comprises an elongated, rigid center core and a fine open mesh covering the center core. The center core includes a central opening extending from a first end of the core to a second end of the core such that air is permitted to pass through the center core. The mesh provides support for a lock of hair wrapped onto the mesh and core sufficient to prevent the hair from being damaged during permanent wave hairstyling. The mesh allows fluid applied to the hair to easily pass therethrough such that at least a portion of the fluid applied to the hair is evaporated as air passes through the center core.

19 Claims, 3 Drawing Sheets

HAIRSTYLING ROD

BACKGROUND OF THE INVENTION

The present invention relates to a hairstyling rod and, more particularly, to such a rod which is adapted for use during permanent wave hairstyling.

Two types of hair rods or rollers are commonly used in hairstyling. The first type is a setting rod. It is used after hair has been shampooed to curl the hair. The curl is not permanent and generally lasts only until the next time the hair is washed. Chemicals are not generally used with hair setting rods, except for perhaps a setting gel or a mousse.

The second type of hair rod is a permanent waving rod. It is intended for use during permanent wave hairstyling. After a lock of hair has been rolled with a permanent waving rod, permanent solution is applied to the hair which causes the hair to relax and take the shape of the waving rod. Thereafter, a neutralizer is applied to the hair which causes the relaxed hair to adopt the shape of the waving rod.

Waving rods oftentimes have uneven outer surfaces and/or large openings extending therethrough. Because hair adopts the shape of the rod during permanent wave hairstyling, uneven surfaces and/or large openings can cause damage to the rolled hair, i.e., frizzy ends and/or breakage of the hair can occur. Further, waving rods do not generally allow for easy passage of fluids through the rod. Hence, rinsing and subsequent drying of the permanent solution and the neutralizer can be very time consuming.

Accordingly, there is a need for an improved permanent waving rod.

SUMMARY OF THE INVENTION

This need is met by the present invention, wherein an improved hairstyling rod is provided which is adapted for use during permanent wave hairstyling.

In accordance with a first aspect of the present invention, a rod device is provided for rolling a lock of hair during permanent wave hairstyling. The rod device comprises an elongated, rigid center core and a fine open mesh covering the center core. The center core includes a central opening extending from a first end of the core to a second end of the core such that air is permitted to pass through the center core. The mesh provides support for a lock of hair wrapped onto the mesh and core sufficient to prevent the hair from being damaged during permanent wave hairstyling. The mesh allows fluid applied to the hair to easily pass therethrough such that at least a portion of the fluid applied to the hair is evaporated as air passes through the center core.

Preferably, the fine open mesh is formed having approximately 16 to 30 separate openings extending along every 1 inch of mesh length. The mesh may be formed from nylon or a like material.

The center core may comprise a frame having a plurality of annular ribs axially spaced from one another along the length of the frame and at least one support rib extending along the length of the frame and connecting the annular ribs to one another. Preferably, the frame includes at least two generally linear support ribs which are parallel to one another. The annular ribs are generally orthogonal to the two support ribs. The center core is preferably formed from a material selected from the group consisting of nylon, neoprene and polypropylene.

The rod device may further comprise an elastic device secured to the first end of the center core and detachably connectable to the second end of the center core to releasably hold the lock of hair wrapped upon the mesh and the center core against unwinding. The center core further comprises a cross rib affixed to one of the annular ribs at the first end of the center core. The elastic device comprises a cap detachably receivable in a central opening in another of the annular ribs at the second end of the center core and an elastic band having a first end secured to the cross rib and a second end releasably attached to the cap. In one embodiment, the cross rib has inner and outer surfaces and includes a shouldered recess extending into the cross rib from the inner surface. The shouldered recess releasably receives the first end of the elastic band such that the elastic band extends from the cross rib in a transverse manner.

In a further embodiment, the cross rib has inner and outer surfaces and includes a shouldered channel extending into the cross rib from the outer surface. The shouldered channel releasably receives the first end of the elastic band such that the elastic band extends from the cross rib in a longitudinal manner.

In accordance with a second aspect of the present invention, a rod device is provided for use in hairstyling. The rod device comprises an elongated, rigid center core and a fine open mesh covering the center core. The center core has a central opening extending from a first end of the core to a second end of the core. The mesh provides support for a lock of hair wrapped about the mesh and core sufficient to prevent the hair from being damaged during hairstyling. The fine mesh allows fluid applied to the hair to pass therethrough such that at least a portion of the fluid applied to the hair is evaporated as air passes through the center core.

The center core may be cylindrical in shape. Alternatively, the center core may have the shape of a hyperboloid.

Accordingly, it is an object of the present invention to provide an improved rod device for use in hairstyling. It is further an object of the present invention to provide an improved hairstyling rod which is adapted for use during permanent wave hairstyling. These and other objects and advantages of the present invention will be apparent from the following description, the accompanying drawings and the appended claims.

DETAILED DESCRIPTION OF THE INVENTION

Figure 1:
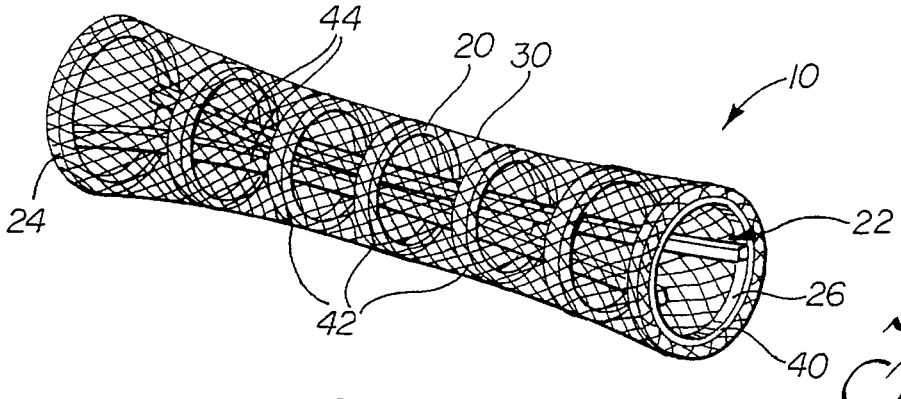
FIG. 1 is a perspective view of a rod device constructed in accordance with a first embodiment of the present invention.
Figure 2:
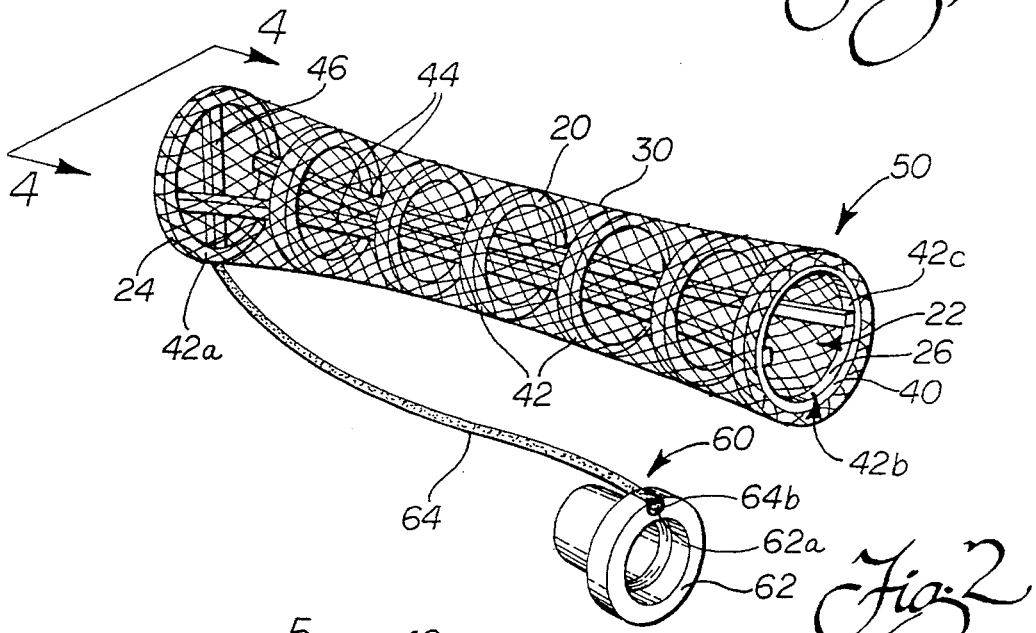
FIG. 2 is a perspective view of a rod device constructed in accordance with a second embodiment of the present invention.
Figure 3:
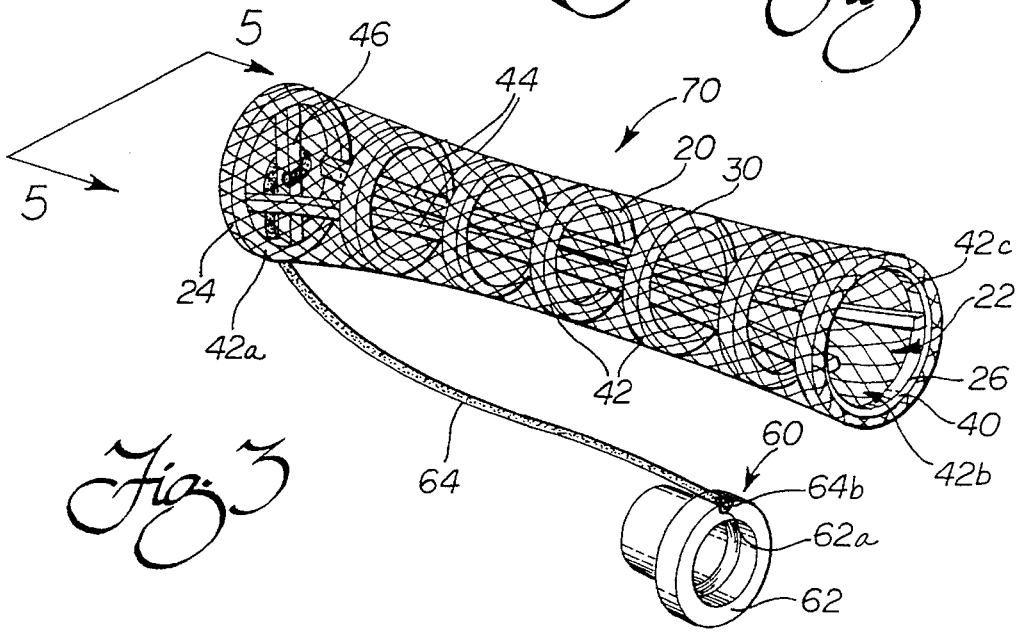
FIG. 3 is a perspective view of a rod device constructed in accordance with a third embodiment of the present invention.
Figure 2A:
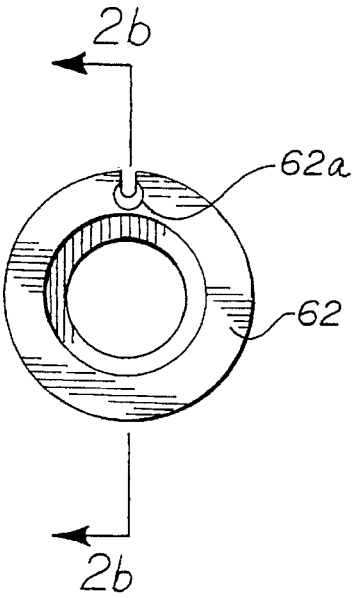
FIG. 2A is an end view of the cap shown in FIG. 2.

A rod device 10 constructed in accordance with a first embodiment of the present invention is shown in FIG. 1. It comprises an elongated, rigid center core 20 and a fine open mesh 30 covering the center core 20. The center core 20 has a central opening 22 extending from a first end 24 of the core 20 to a second end 26 of the core 20. The center core 20 comprises a frame 40 having a plurality of annular ribs 42 axially spaced from one another along the length of the frame 40 and two support ribs 44 extending along the length of the frame 40 and connecting the annular ribs 42 to one another. The two support ribs 44 are generally parallel to one another and the annular ribs 42 are generally orthogonal to the two support ribs 44. The frame 40 is preferably formed from a material selected from the group consisting of nylon, neoprene and polypropylene. In the embodiment illustrated in FIG. 1, the frame 40 has the shape of a hyperboloid.

The mesh 30 preferably has approximately 16 to 30, and most preferably 18, separate openings extending along every 1 inch of mesh length, whether taken along the longitudinal direction of the core 20, or in a direction orthogonal to the longitudinal direction of the core 20. The mesh 30 may be formed from nylon, tetrafluoroethylene (e.g., Teflon®) or other appropriate material. An example mesh product is a nylon netting that is commercially available from Mandel Fabric.

The mesh 30 is attached to the center core 20 by way of a conventional adhesive or heat sealing. The mesh 30, after being secured to the core 20, has sufficient stiffness to support a lock of hair (not shown) wrapped about the mesh 30 and the core 20 during permanent wave hairstyling. Since the attached mesh 30 defines a generally even outer surface along the rod device 10, risk of damage to rolled hair during permanent wave hairstyling, such as frizzy ends and/or breakage of the hair, is substantially reduced. Further, openings in the mesh 30 permit fluid applied to the hair to easily pass therethrough such that at least a portion of the fluid applied to the hair is evaporated as air passes through the opening 22 of the center core 20.

Figure 4A:
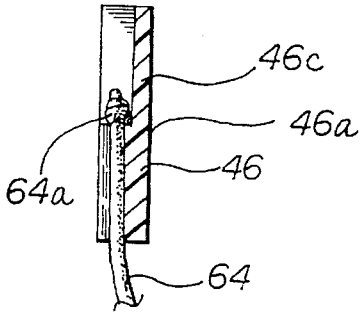
FIG. 4A is a view taken along section line 4A—4A in FIG. 4.
Figure 2B:
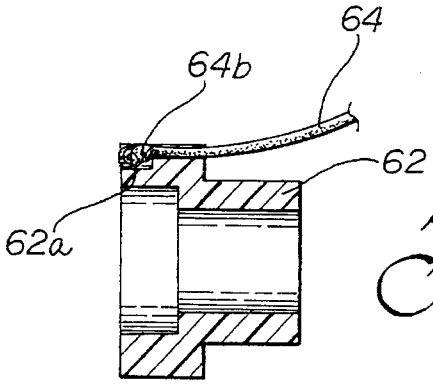
FIG. 2B is a view taken along section line 2B—2B in FIG. 2A.
Figure 5A:
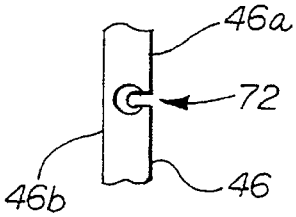
FIG. 5A is a view taken along section line 5A—5A in FIG. 5.
Figure 4:
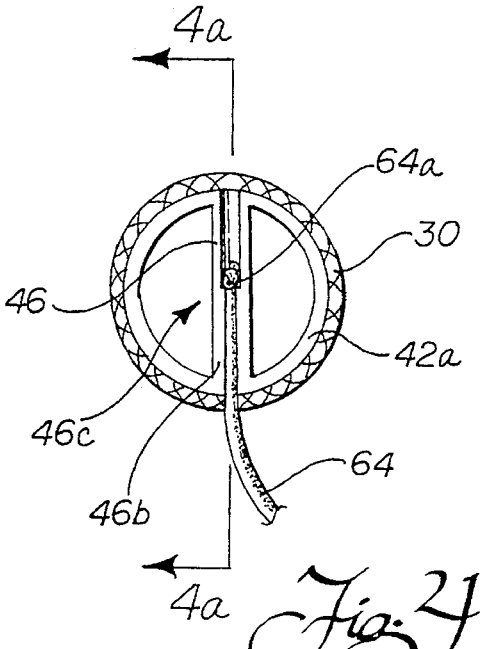
FIG. 4 is a view taken along view line 4—4 in FIG. 2.
Figure 5:
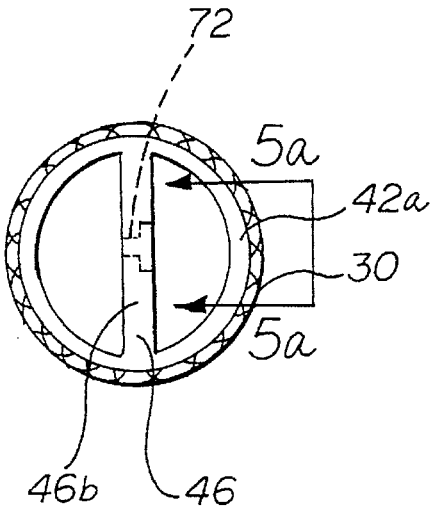
FIG. 5 is a view taken along view line 5—5 in FIG. 3 without the elastic band.
Figure 5B:
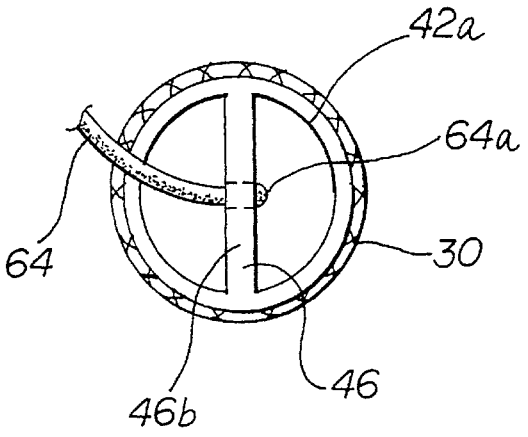
FIG. 5B is an end view of the rod device shown in FIG. 5.

A rod device 50, formed in accordance with a second embodiment of the present invention, is shown in FIGS. 2, 2A, 2B, 4 and 4A, where like reference numerals indicate like elements. In this embodiment, the rod device 50 includes an elastic device 60 secured to the first end 24 of the center core 20 and detachably connectable to the second end 26 of the center core 20 to releasably hold a lock of hair (not shown) wrapped upon the mesh 30 and the center core 20 against unwinding. The frame 40 further comprises a cross rib 46 integral with a first annular rib 42*a* at the first end 24 of the center core 20. The elastic device 60 comprises a cap 62 detachably receivable in a central opening 42*b* in a second annular rib 42*c* at the second end 26 of the center core 20. The elastic device 60 also includes an elastic band 64 having a first end 64*a* secured to the cross rib 46 and a second end 64*b* releasably received in a shouldered recess 62*a* of the cap 62, see FIGS. 2A and 2B. As shown in FIGS. 4 and 4A, the cross rib 46 has inner and outer surfaces 46*a* and 46*b* and includes a shouldered channel 46*c* extending into the cross rib 46 from the outer surface 46*b*. The shouldered channel 46*c* releasably receives the first end 64*a* of the elastic band 64 such that the elastic band 64 extends from the cross rib 46 in a longitudinal manner.

A rod device 70, formed in accordance with a third embodiment of the present invention, is shown in FIGS. 3, 5, 5A and 5B, where like reference numerals indicate like elements. In this embodiment, the cross rib 46 has a shouldered recess 72 extending into the cross rib 46 from the inner surface 46*a* of the cross rib 46. The shouldered recess 72 releasably receives the first end 64*a* of the elastic band 64 such that the elastic band 64 extends from the cross rib 46 in a transverse manner, see FIG. 3.

Figure 6:
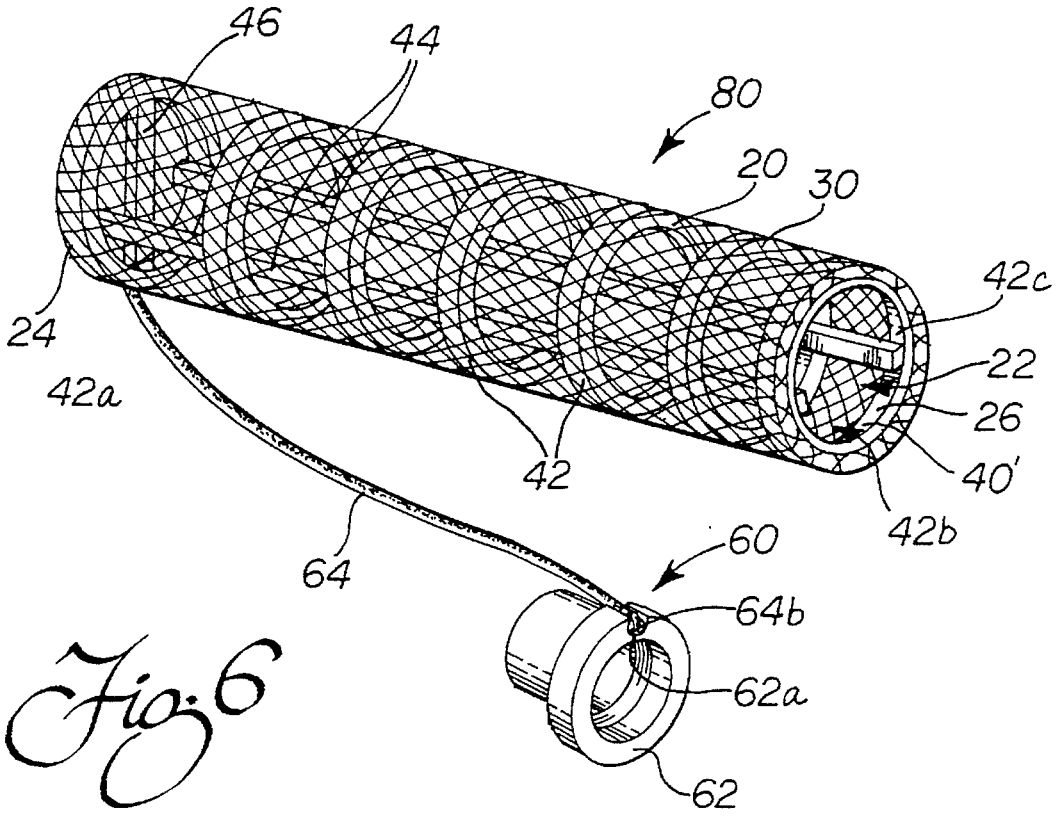
FIG. 6 is a perspective view of a rod device constructed in accordance with a fourth embodiment of the present invention.

A rod device 80, formed in accordance with a fourth embodiment of the present invention, is shown in FIG. 6, where like reference numerals indicate like elements. The rod device 80 is substantially similar to the rod device 50 shown in FIG. 2 except that its frame 40' has a cylindrical shape rather than the hyperboloid shape of the frame 40 of the rod device 50.

While certain representative embodiments and details have been shown for purposes of illustrating the invention, it will be apparent to those skilled in the art that various changes in the devices disclosed herein may be made without departing from the scope of the invention, which is defined in the appended claims.

What is claimed is:

1. A rod device for rolling a lock of hair during permanent wave hairstyling, said rod device comprising:

an elongated, rigid center core including a central opening extending from a first end of said core to a second end of said core such that air is permitted to pass through said center core; and, a fine open mesh covering said center core and having approximately 16 to 30 separate openings per every 1 inch of mesh length for providing support for a lock of hair wrapped onto said mesh and core sufficient to prevent the hair from being damaged during permanent wave hairstyling, said fine mesh allowing fluid applied to the hair to pass therethrough such that at least a portion of the fluid applied to the hair is evaporated as air passes through said center core.

2. A rod device as set forth in claim 1, wherein said fine open mesh comprises a nylon open mesh.

3. A rod device as set forth in claim 1, wherein said center core comprises a frame having a plurality of annular ribs axially spaced from one another along the length of said frame and at least one support rib extending along the length of said frame and connecting said annular ribs to one another.

4. A rod device as set forth in claim 3, wherein said frame includes two generally linear support ribs which are generally parallel to one another.

5. A rod device as set forth in claim 3, wherein said annular ribs are generally orthogonal to said at least one support rib.

6. A rod device as set forth in claim 1, wherein said center core is made from a material selected from the group consisting of nylon, neoprene and polypropylene.

7. A rod device as set forth in claim 1, further comprising an elastic device secured to said first end of said center core and detachably connectable to said second end of said center core to releasably hold the lock of hair wrapped upon said mesh and said center core against unwinding.

8. A rod device as set forth in claim 7, wherein said center core further comprises a cross rib affixed to one of said annular ribs at said first end of said center core and said elastic device comprises a cap detachably receivable in a central opening in another of said annular ribs at said second end of said center core and an elastic band having a first end secured to said cross rib and a second end releasably attached to said cap.

9. A rod device as set forth in claim 8, wherein said cross rib has inner and outer surfaces and includes a shouldered recess extending into said cross rib from said inner surface, said shouldered recess releasably receiving said first end of said elastic band such that said elastic band extends from said cross rib in a transverse manner.

10. A rod device as set forth in claim 8, wherein said cross rib has inner and outer surfaces and includes a shouldered channel extending into said cross rib from said outer surface, said shouldered channel releasably receiving said first end of said elastic band such that said elastic band extends from said cross rib in a longitudinal manner.

11. A rod device for use in hairstyling comprising:

an elongated, rigid center core having a central opening extending from a first end of said core to a second end of said core; and, a fine open mesh covering said center core and having approximately 16 to 30 separate openings per every 1 inch of mesh length for providing support for a lock of hair wrapped about said mesh and core sufficient to prevent the hair from being damaged during hairstyling, said fine mesh allowing fluid applied to the hair to pass therethrough such that at least a portion of the fluid applied to the hair is evaporated as air passes through said center core.

12. A rod device as set forth in claim 11, wherein said fine open mesh comprises a nylon open mesh.

13. A rod device as set forth in claim 11, wherein said center core comprises a frame having a plurality of annular ribs axially spaced from one another along the length of said frame and at least one support rib extending along the length of said frame and connecting said annular ribs to one another.

14. A rod device as set forth in claim 13, wherein said frame includes two generally linear support ribs which are generally parallel to one another.

15. A rod device as set forth in claim 11, wherein said center core generally has the shape of a hyperboloid.

16. A rod device as set forth in claim 11, further comprising an elastic device secured to said first end of said center core and detachably connectable to said second end of said center core to releasably hold the lock of hair wrapped upon said mesh and said center core against unwinding.

17. A rod device as set forth in claim 16, wherein said center core further comprises a cross rib affixed to one of said annular ribs at said first end of said center core and said elastic device comprises a cap detachably receivable in a central opening in another of said annular ribs at said second end of said center core and an elastic band having a first end secured to said cross rib and a second end releasably attached to said cap.

18. A rod device as set forth in claim 17, wherein said cross rib has inner and outer surfaces and includes a shouldered recess extending into said cross rib from said inner surface, said shouldered recess releasably receiving said first end of said elastic band such that said elastic band extends from said cross rib in a transverse manner.

19. A rod device for rolling a lock of hair during permanent wave hairstyling, said rod device comprising:

an elongated, rigid center core including a central opening extending from a first end of said core to a second end of said core such that air is permitted to pass through said center core; and, a fine open mesh covering at least a portion of said center core and having approximately 16 to 30 separate openings per inch of mesh length for providing support for a lock of hair wrapped onto said mesh and core sufficient to prevent the hair from being damaged during permanent wave hairstyling, said fine mesh allowing fluid applied to the hair to pass therethrough such that at least a portion of the fluid applied to the hair is evaporated as air passes through said center core.

* * * * *